US008315546B2

(12) United States Patent
Kamijo et al.

(10) Patent No.: US 8,315,546 B2
(45) Date of Patent: Nov. 20, 2012

(54) TRANSFER MEMBER AND IMAGE FORMING APPARATUS INCLUDING A TRANSFER ROLLER WITH A GRIPPING MEMBER

(75) Inventors: Koichi Kamijo, Matsumoto (JP); Satoshi Chiba, Suwa (JP); Shinichi Tanaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 284 days.

(21) Appl. No.: 12/759,494

(22) Filed: Apr. 13, 2010

(65) Prior Publication Data

US 2010/0260519 A1 Oct. 14, 2010

(30) Foreign Application Priority Data

Apr. 14, 2009 (JP) ..... 2009-097956

(51) Int. Cl.
*G03G 15/01* (2006.01)
*G03G 15/00* (2006.01)

(52) U.S. Cl. ..... 399/304; 399/388; 399/397

(58) Field of Classification Search ..... 399/297, 399/304, 388, 396, 397
See application file for complete search history.

(56) References Cited

U.S. PATENT DOCUMENTS 4,723,145 A * 2/1988 Takada et al. ..... 399/36
5,016,056 A * 5/1991 Johnson et al. ..... 399/304
5,325,155 A * 6/1994 Perry ..... 399/167
6,243,556 B1 6/2001 Shin

FOREIGN PATENT DOCUMENTS

JP 03-004241 A 1/1991
JP 03128067 B 9/2000

* cited by examiner

*Primary Examiner* — Joseph S Wong
(74) *Attorney, Agent, or Firm* — Workman Nydegger

(57) ABSTRACT

A transfer device includes an image carrier that carries an image and a transfer roller having a recessed section, a transfer medium gripping member that is disposed in the recessed section and grips a transfer medium, and an elastic member that forms a transfer nip by abutting upon the image carrier, the transfer roller transferring the image carried by the image carrier to the transfer medium by abutting upon the image carrier. The transfer medium gripping member grips the transfer medium when the recessed section moves to a position of the transfer nip and the image carrier and the transfer roller do not contact to each other.

4 Claims, 8 Drawing Sheets

TRANSFER MEMBER AND IMAGE FORMING APPARATUS INCLUDING A TRANSFER ROLLER WITH A GRIPPING MEMBER

BACKGROUND

1. Technical Field

The present invention relates to an electrophotographic transfer device and an image forming apparatus that transfer an image from an image carrier to a transfer medium such as paper, using a transfer roller in pressing-contact with the image carrier carrying the image to be transferred.

2. Related Art

In a wet type image forming apparatus that uses liquid developer, because a transfer surface on a toner image side of a transfer medium such as paper is in pressing-contact with an intermediate transfer medium, the transfer medium is liable to stick to the intermediate transfer medium after a transfer. In connection to this, to date, an image forming apparatus in which the transfer medium is separated from the transfer roller by blowing air onto the edge of the transfer medium after a transfer has been proposed (see, for example, Japanese Patent No. 3128067).

On the other hand, among image forming apparatuses that use a dry type developer, an image forming apparatus in which a toner image of a photoreceptor is transferred to a transfer medium in a state in which the edge of the transfer medium is gripped by grippers of a transfer drum that is in pressing-contact with the photoreceptor has been proposed (see, for example, JP-A-3-4241). By performing the transfer in a state in which the edge of the transfer medium is gripped, the transfer medium is easily separated from the photoreceptor after the transfer.

However, in the image forming apparatus described in the above-referenced Japanese Patent No. 3128067, it is difficult to securely perform separation of the transfer medium because the air is simply blown onto the edge of the transfer medium.

Consequently, the technique of separating the edge of the transfer medium by gripping described in JP-A-3-4241 can be applied to the image forming apparatus using the liquid developer described in Japanese Patent No. 3128067. However, because the transfer drum having the transfer medium gripping member described in JP-A-3-4241 is rotating during the transfer operation, it is difficult to grip the transfer medium at a fixed position securely and stably, the transfer medium being transported toward the transfer drum. In the image forming apparatus described in JP-A-3-4241, no consideration is given at all of how the transfer medium gripping member, which is in motion, should securely and stably grip the transfer medium at a fixed position on the transfer medium.

Therefore, it is difficult to perform excellent image formation even if the technique for separating the transfer medium described in JP-A-3-4241 is applied to the image forming apparatus described in Japanese Patent No. 3128067.

SUMMARY

An advantage of some aspects of the invention is to provide a transfer device and an image forming apparatus capable of performing more excellent image formation by securely and stably gripping the transfer medium before the transfer.

In order to realize the advantage described above, a transfer device and an image forming apparatus according to an aspect of the invention are configured so that a transfer medium gripping member grips a transfer medium being transported at a position at which a recessed section of a transfer roller where the transfer medium gripping member is arranged opposes an image carrier. Thereby, fluctuations in the transfer roller speed due to pressing-contact of the image carrier and the transfer roller do not exert an adverse effect. Accordingly, the transfer medium can be securely and stably gripped by the transfer medium gripping member. As a result, the transfer medium is transferred while being securely and stably gripped, and therefore transfer efficiency can be improved and more excellent image formation is realized.

Also, a second peripheral speed v2 (mm/s) of the transfer roller when the transfer roller does not abut upon the image carrier is preferably made lower than a first peripheral speed v1 (mm/s) of the transfer roller when the transfer roller abuts upon the image carrier. Thereby, the transfer medium can be gripped by the transfer medium holding member more securely and more stably.

Further, a moving speed v3 (mm/s) of the image carrier and a moving speed v4 (mm/s) of the transfer medium transported from a gate roller are preferably made equal or approximately equal. Thereby, the image on the preferably image carrier can be transferred more accurately while the transfer medium is gripped by the transfer medium gripping member more securely and more stably.

Furthermore, a drive source that drives the image carrier is preferably made to be the same as a drive source that drives the gate roller. Thereby, rotation of the image carrier and the moving speed of the transfer medium transported from the gate roller can be more accurately controlled in a mutually related manner. In addition, the number of parts can be reduced and the image forming apparatus can be configured more simply.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
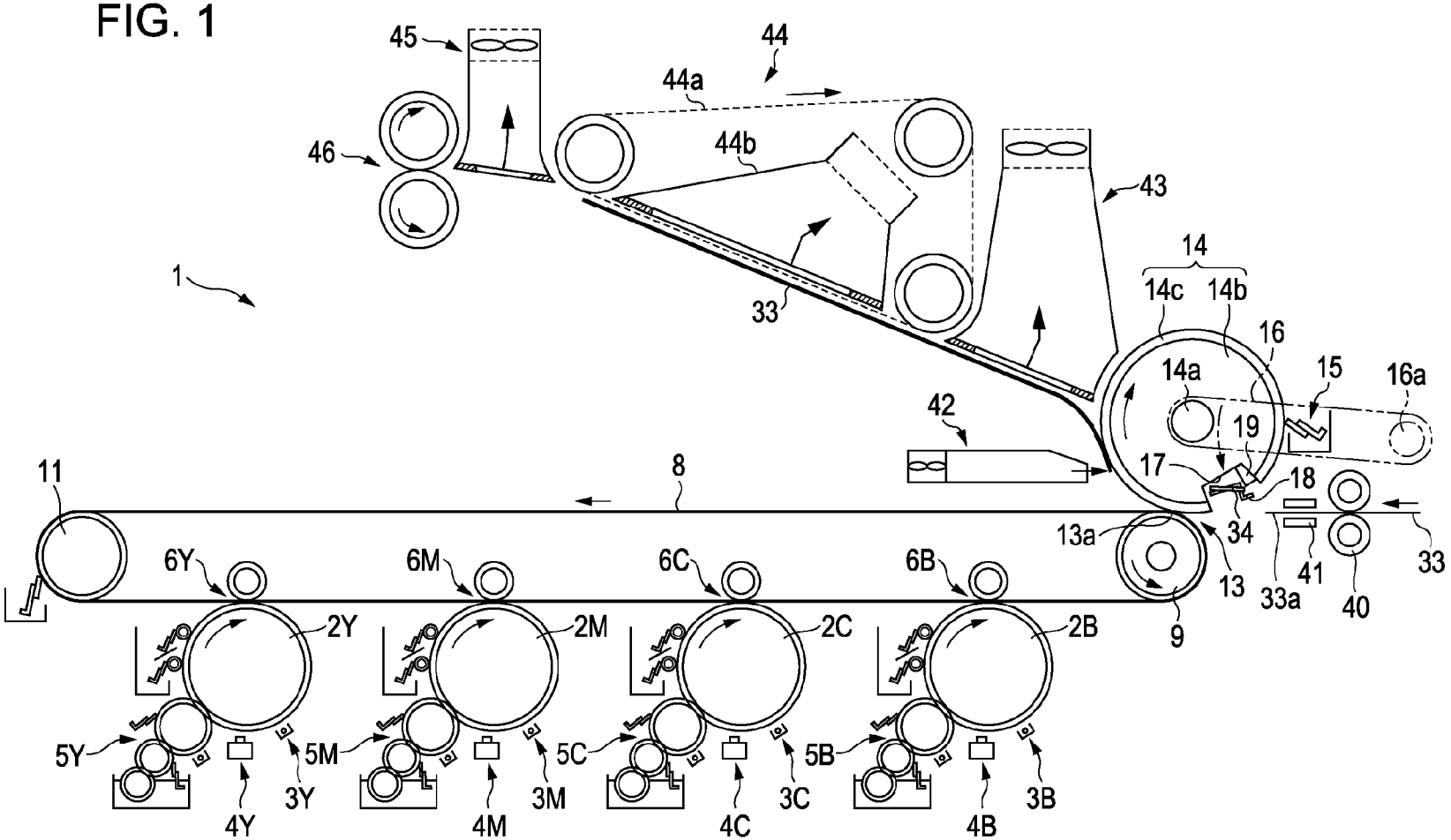
FIG. 1 is a drawing schematically and partially showing an image forming apparatus according to an embodiment of the invention.

Embodiments of the invention will be described below referring to the drawings.

FIG. 1 is a drawing schematically and partially showing an embodiment of an image forming apparatus according to an embodiment of the invention.

An image forming apparatus 1 of the embodiment performs image formation using liquid developer including a solid toner and a carrier liquid. As shown in FIG. 1, the image forming apparatus 1 includes photoreceptors 2Y, 2M, 2C, 2K which are image carriers of yellow (Y), magenta (M), cyan (C), and black (K) arranged horizontally or generally horizontally in tandem. Here, in the individual photoreceptors 2Y, 2M, 2C, and 2K, 2Y represents the photoreceptor of yellow, 2M represents the photoreceptor of magenta, 2C represents the photoreceptor of cyan, and 2K represents the photoreceptor of black. Also, with respect to other members, members of each color are represented by affixing Y, M, C, K of each color respectively to numerals of the members in a similar manner.

In the periphery of respective photoreceptors 2Y, 2M, 2C, 2K, corresponding charging units 3Y, 3M, 3C, 3K are respectively arranged. Also, exposure units 4Y, 4M, 4C, 4K, developing units 5Y, 5M, 5C, 5K, and primary transfer units 6Y, 6M, 6C, 6K are respectively disposed in this order following respective charging units 3Y, 3M, 3C, 3K in the rotational direction of respective photoreceptors 2Y, 2M, 2C, 2K. Further, photoreceptor cleaning units that clean the corresponding photoreceptors are disposed in respective photoreceptors 2Y, 2M, 2C, 2K although they are not shown.

In addition, the image forming apparatus 1 is equipped with an intermediate transfer belt 8 (equivalent to an image carrier) of an endless type and is a transfer belt. The intermediate transfer belt 8 is arranged above the respective photoreceptors 2Y, 2M, 2C, 2K. Also, the intermediate transfer belt 8 is in press-contacting with respective photoreceptors 2Y, 2M, 2C, 2K in respective primary transfer units 6Y, 6M, 6C, 6K.

Although it is not shown, the intermediate transfer belt 8 is formed as a comparatively soft elastic belt with a three layer structure having, for example, a flexible substrate of a resin or the like, an elastic layer of rubber or the like formed on the surface of the substrate, and a surface layer formed on the surface of the elastic layer. Needless to say, the intermediate transfer belt 8 is not limited to this. The intermediate transfer belt 8 runs over an intermediate transfer belt drive roller 9 to which the driving force of the drive source of a motor and the like is transmitted and an intermediate transfer belt tension roller 11. The intermediate transfer belt 8 is made to be rotatable in a direction shown by an arrow in a state in which tension is applied.

Further, the arrangement order of the members such as the photoreceptors corresponding to respective colors Y, M, C, K is not limited to that of the embodiment shown in FIG. 1 and can be arbitrarily set.

On the intermediate transfer belt drive roller 9 side of the intermediate transfer belt 8, a secondary transfer unit 13, which is a transfer device, is arranged. The secondary transfer unit 13 includes a secondary transfer roller 14 and a secondary transfer roller cleaning unit 15. Both ends of a rotary shaft 14*a* of the secondary transfer roller 14 are rotatably supported by a pair of secondary transfer roller support frames 16. The secondary transfer roller support frames 16 rotatingly rock around a rotary shaft 16*a* (turning fulcrum) supported by an apparatus body (not shown) and are energized in a direction shown by an arrow by an energizing unit such as a spring (not shown). The secondary transfer roller 14 is brought into pressing-contact to the intermediate transfer belt 8 by the pressing force of the energizing unit. At this time, the intermediate transfer belt drive roller 9 acts as a backup roller with respect to the pressing-contact of the secondary transfer roller 14.

Figure 2:
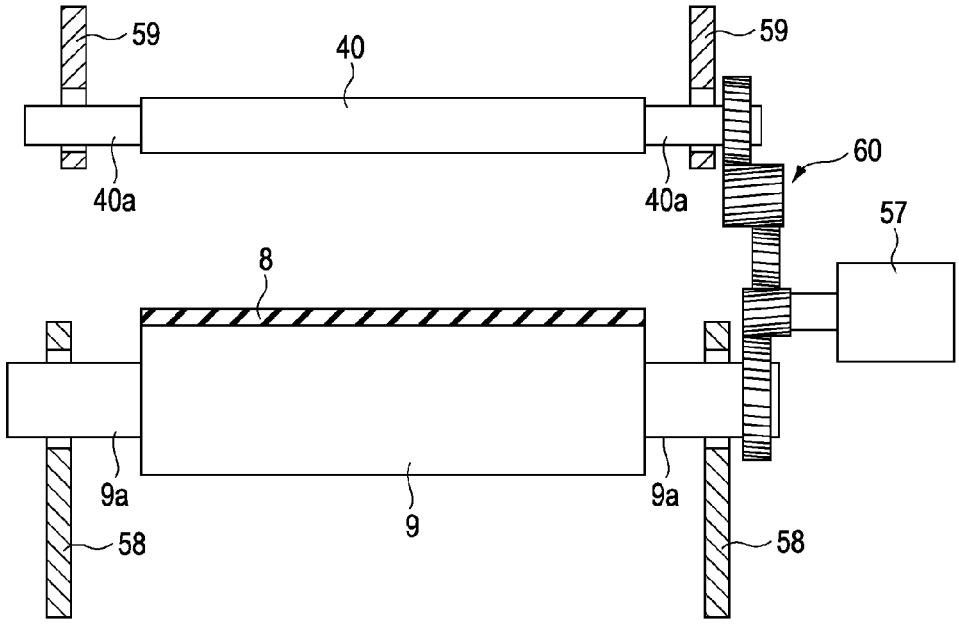
FIG. 2 is a drawing explaining the pressing-contact direction of a secondary transfer roller.

The secondary transfer roller 14 is rotationally driven by a drive source which is a motor whose rotary speed is controllable. Also, the secondary transfer roller 14 includes a recessed section 17 extending in the axial direction of the secondary transfer roller 14. Further, the secondary transfer roller 14 includes a sheet-like elastic member 14*c* wound around the outer peripheral surface of an arc section of a base member 14*b*. A resistive layer is formed on the outer peripheral surface of an arc section of the secondary transfer roller 14 by the elastic member 14*c*. Furthermore, a secondary transfer nip 13*a* is formed between the intermediate transfer belt 8 and the elastic member 14*c* of the secondary transfer roller 14 as shown in FIG. 1 and FIG. 2.

Also, a transfer bias that transfers a toner image transferred to the intermediate transfer belt 8 to a transfer medium such as transfer paper is applied to the secondary transfer roller 14. Further, the secondary transfer roller 14 rotates in the direction shown by an arrow as the intermediate transfer belt 8 rotates in the direction shown by an arrow and is applied with the transfer bias, thereby transferring the toner image from the intermediate transfer belt 8 to the transfer medium at the secondary transfer nip 13*a*.

A first peripheral speed v1 mm/s of the secondary transfer roller 14 when the elastic member 14*c* of the secondary transfer roller 14 abuts upon the intermediate transfer belt 8 due to the pressing force of the energizing unit is slightly faster than a second peripheral speed v2 mm/s of the secondary transfer roller 14 when the elastic member 14*c* of the secondary transfer roller 14 does not abut upon the intermediate transfer belt 8 ($v2<v1$).

In that case, times when the elastic member 14*c* abuts upon the intermediate transfer belt 8 include the time when just a part of the recessed section 17 opposes the position of the secondary transfer nip and a portion of the elastic member 14*c* on either side of the recessed section 17 in the rotational direction of the secondary transfer roller 14 abuts upon the intermediate transfer belt 8. Also, when the elastic member 14*c* does not abut upon the intermediate transfer belt 8, the recessed section 17 opposes the position of the secondary transfer nip and edges on both sides of the recessed section 17 in the rotational direction of the secondary transfer roller 14 do not abut upon the intermediate transfer belt 8.

Further, a moving speed v3 mm/s of the intermediate transfer belt 8 and a transport speed of a transfer medium 33 (moving speed of the transfer medium 33) v4 mm/s given by the gate roller 40 are made to be approximately equal to each other. As shown in FIG. 2, in the image forming apparatus 1 of this embodiment, a rotary shaft 9*a* of the intermediate transfer belt drive roller 9 is rotatably supported by an intermediate transfer belt drive roller support frame 58. Also, a rotary shaft 40*a* of the gate roller 40 is rotatably supported by a gate roller support frame 59. Further, the rotational driving force of a gate roller drive motor 57 which is common to a motor of the drive source driving the intermediate transfer belt drive roller 9 and is the drive source driving the gate roller 40 is transmitted to the intermediate transfer belt drive roller 9 (intermediate transfer belt 8) and gate roller 40 through a gear train 60.

Also, the first peripheral speed v1 mm/s of the secondary transfer roller 14 is equal to or approximately equal to the moving speed v4 mm/s of the transfer medium 33 transported from the gate roller 40 (v1=v4 or v1≅v4). In order that grippers 18 can grip an edge 33*a* of the transfer medium 33 more securely and more stably, it is preferable that the first peripheral speed v1 of the secondary transfer roller 14 is very slightly lower than the moving speed v4 of the transfer medium 33. Accordingly, the second peripheral speed v2 of the secondary transfer roller 14 is lower than the moving speed v4 of the transfer medium 33 (v2<v4).

The grippers 18, serving as transfer medium gripping members according to an embodiment of the invention, and gripper support sections 19, which are transfer medium gripping member receiving members where the grippers 18 are seated, are arranged inside the recessed section 17. Although it is not shown, the grippers 18 are disposed in a comb-teeth-like shape in a designated number along the axial direction of the secondary transfer roller 14. The gripper supporters 19 are disposed so as to correspond to respective grippers 18.

Figure 3:
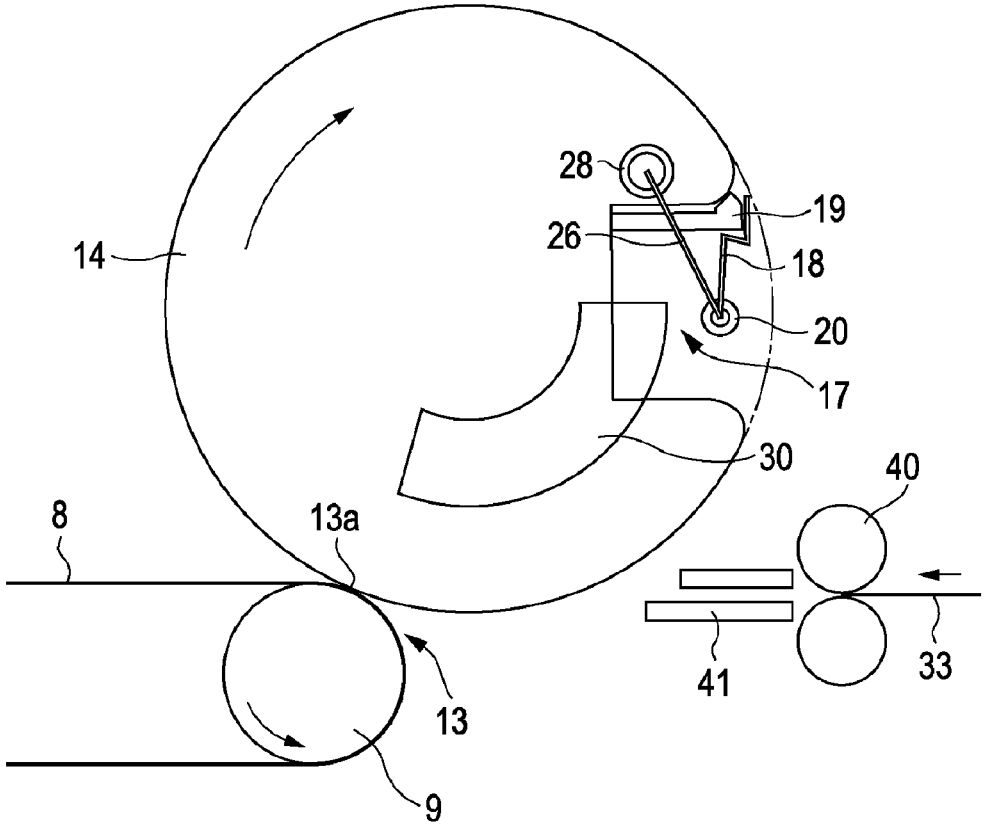
FIG. 3 is a drawing explaining a part of a gripping process of the transfer medium performed by the grippers.

As shown in FIG. 3, the individual grippers 18 are arranged on a rotary shaft 20 so as to rotate integrally with the rotary shaft 20. At one end of the rotary shaft 20, a gripper control cam follower 28 is arranged and attached thereto through an arm 26. Also, the gripper control cam follower 28 is controlled by a gripper control cam 30, which is fixed to the apparatus body, by the rotation of the secondary transfer roller 14. Further, the control of abutting and separation of the grippers 18 with respect to the gripper supporters 19 is performed by the control of the gripper control cam follower 28. Furthermore, immediately before the recessed section 17 reaches the secondary transfer nip 13*a*, the grippers 18 grip the edge 33*a* of the transfer medium 33 transported from the gate roller 40 through a transfer medium feed guide 41 between the grippers 18 and the transfer medium gripping sections 19*b* of the gripper supporters 19.

The action of the grippers 18 gripping the edge 33*a* of the transfer medium 33 transported from the gate roller 40 will be described in more detail.

As shown in FIG. 3, before the feed position of the transfer medium 33 from the gate roller 40 in the rotational direction of the secondary transfer roller 14, the grippers 18 are set to a position where they abut upon the gripper supporters 19 and do not grip the transfer medium 33. By rotation of the secondary transfer roller 14 in the direction shown by an arrow, the grippers 18 approach the feed position of the transfer medium 33 from the gate roller 40. At this time, because the elastic member 14*c* is abutted against the intermediate transfer belt 8, the elastic member of the secondary transfer roller 14 has the first peripheral speed v1. Also, the gripper control cam follower 28 abuts upon the cam face of the gripper control cam 30. Thereafter, according to the rotation of the secondary transfer roller 14 in the same direction, the gripper control cam follower 28 is controlled by the gripper control cam 30.

Figure 4:
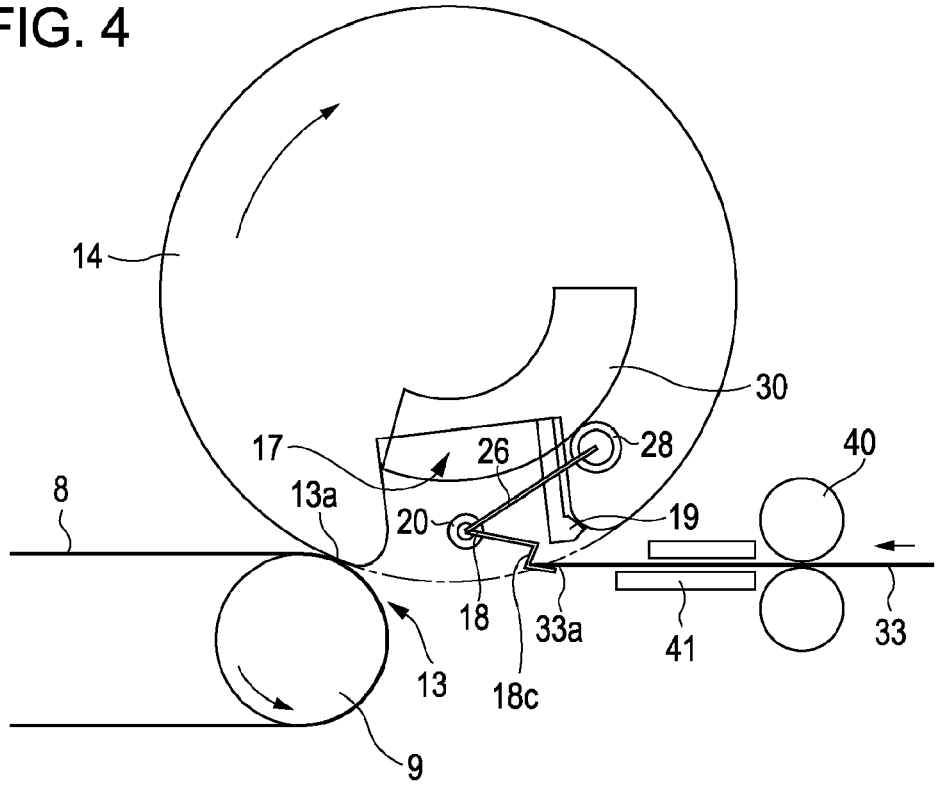
FIG. 4 is a drawing explaining another part of the gripping process of the transfer medium performed by the grippers.
Figure 5:
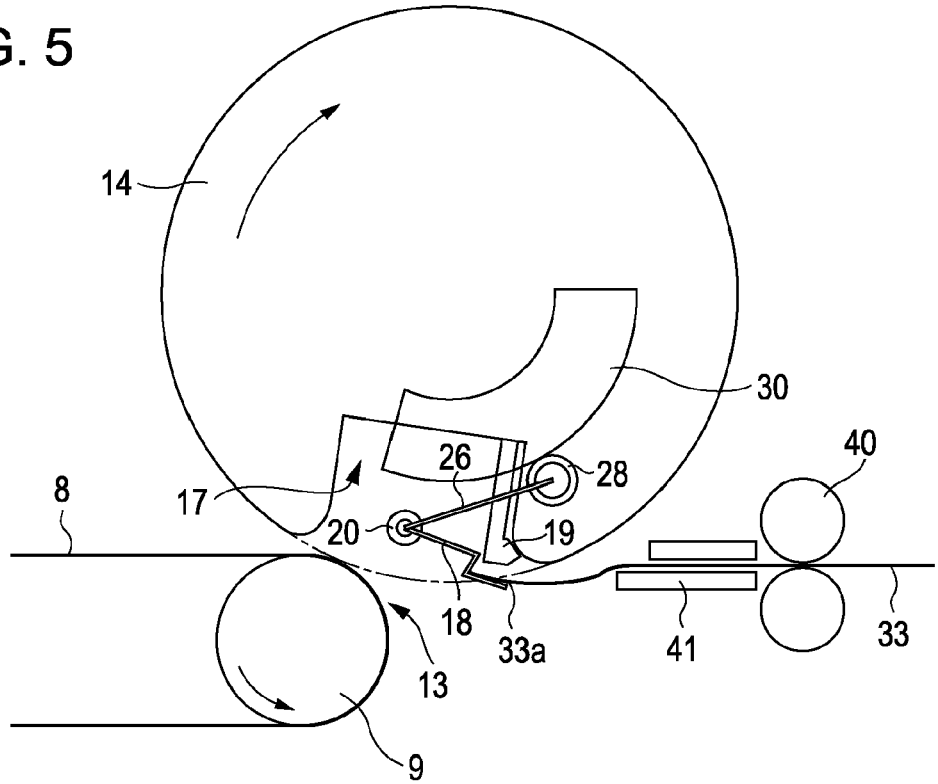
FIG. 5 is a drawing explaining yet another part of the gripping process of the transfer medium performed by the grippers.

When the grippers 18 reach a position immediately before the feed position of the transfer medium 33, the grippers 18 depart from the gripper supporters 19 under the control of the gripper control cam follower 28 by the gripper control cam 30. Also, as shown in FIG. 4, when the grippers 18 reach the feed position of the transfer medium 33, the edge 33*a* of the transfer medium 33 enters between the grippers 18 and the gripper supporters 19. When the secondary transfer roller 14 rotates further in the same direction, the recessed section 17 comes to oppose the secondary transfer nip 13*a* position, and the secondary transfer roller 14 ceases abutting upon the intermediate transfer belt 8. Accordingly, the rotational speed of the secondary transfer roller 14 slightly drops and eventually reaches the second peripheral speed v2. Because the moving speed v4 of the transfer medium 33 is faster than the second peripheral speed v2, the tip of the transfer medium 33 abuts upon the corner sections of step sections 18*c* of the grippers 18 and is positioned against the grippers 18 as shown in FIG. 5.

Figure 6:
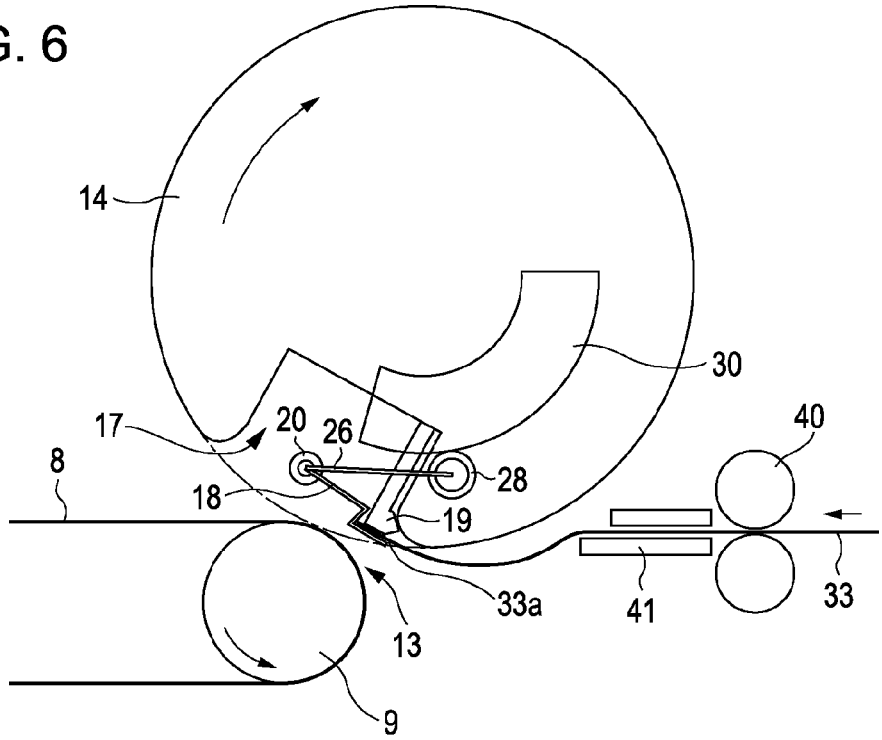
FIG. 6 is a drawing explaining yet another part of the gripping process of the transfer medium performed by the grippers.

Also, when the secondary transfer roller 14 rotates further in the same direction, as shown in FIG. 6, the grippers 18 grip the edge 33*a* of the transfer medium 33 between them and the gripper supporters 19. At this time, the elastic member 14*c* of the secondary transfer roller 14 is not abutted against the intermediate transfer belt 8. Also, due to the speed difference between the first peripheral speed v1 of the secondary transfer roller 14 and the moving speed v4 of the transfer medium 33, the edge 33*a* of the transfer medium 33 becomes curved. The force with which the grippers 18 grip the transfer medium 33 is made to be smaller than the force with which the gate roller 40 transports the transfer medium 33 (transfer medium gripping force of the grippers 18<transfer medium transporting force of the gate roller 40). By reducing the force used for gripping the transfer medium 33 thus, the transfer medium 33 is prevented from being damaged such as being folded by gripping as much as possible. Thus, the transfer medium 33 is positioned with respect to the secondary transfer roller 14 and securely moves toward the secondary transfer nip 13*a* following the rotation of the secondary transfer roller 14.

Figure 7:
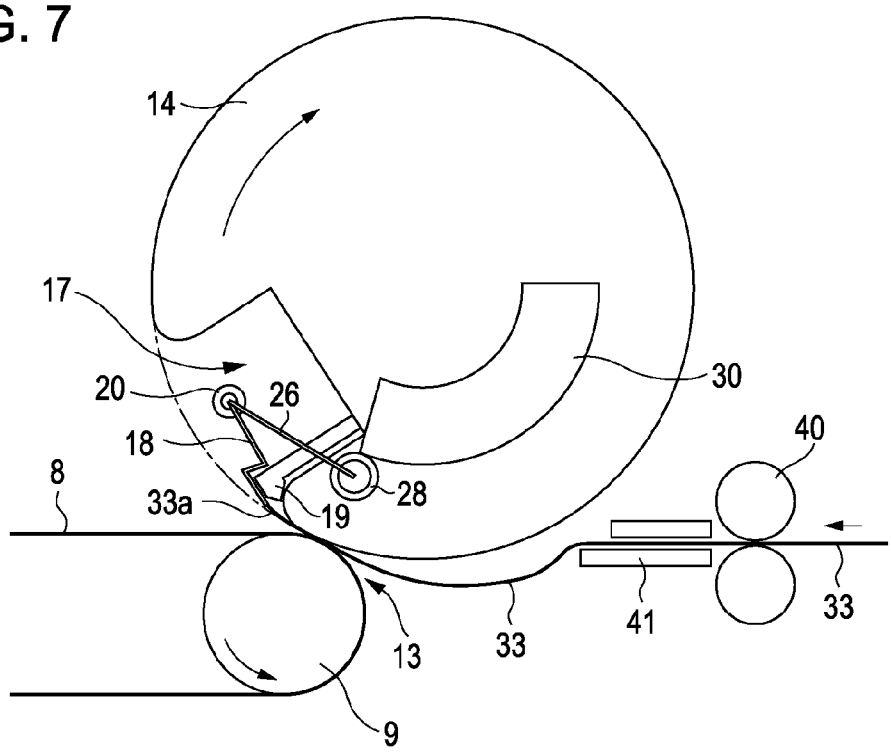
FIG. 7 is a drawing explaining yet another part of the gripping process of the transfer medium performed by the grippers.

As shown in FIG. 7, the toner image on the intermediate transfer belt 8 is transferred to the transfer medium 33 at the secondary transfer nip 13*a*. When the a part of the edge 33*a* of the transfer medium 33 gripped by respective grippers 18 passes the secondary transfer nip 13*a* and the gripper control cam follower 28 is dislocated from the cam face of the gripper control cam 30, respective grippers 18 move in the direction away from the gripper supporters 19, and gripping of the edge 33*a* of the transfer medium 33 is released.

The peripheral length of the secondary transfer roller 14 excluding the width portion of the recessed section 17 in the secondary transfer roller rotational direction is set to be longer than the length of the transfer medium 33 in the transfer medium moving direction whose length in the transfer medium moving direction is longest among the different kinds of the transfer medium 33 used in the image forming apparatus 1 of this embodiment. Thereby, the toner image on the intermediate transfer belt 8 can be securely transferred even onto the transfer medium 33 having the longest length.

Also, inside the recessed section 17, a predetermined number of projecting claws 34 as transfer medium separating members are disposed in a direction orthogonal or approximately orthogonal to the transfer medium transporting direction (axial direction of the secondary transfer roller 14). Respective projecting claws 34 move linearly between a retracted position and a projecting position. The linear motion of respective projecting claws is controlled by a projecting claw control cam (not shown) fixed to the apparatus body.

Further, before or after the above-referenced release of the transfer medium gripping by the grippers 18 that have passed the secondary transfer nip 13*a*, respective projecting claws 34 are projected to the projecting position. Thereby, the back face of the edge of the transfer medium 33 (the face on the side opposite to the face of the transfer medium onto which the toner image is transferred) is projected from respective projecting claws 34. Thus, the transfer medium 33 is separated from the secondary transfer roller 14.

In the meantime, in the image forming apparatus according to this embodiment, in order to perform the rotation control of the secondary transfer roller 14, the rotation control of the gate roller 40, and the moving speed control of the transfer medium 33, their speeds are detected.

Figure 8:
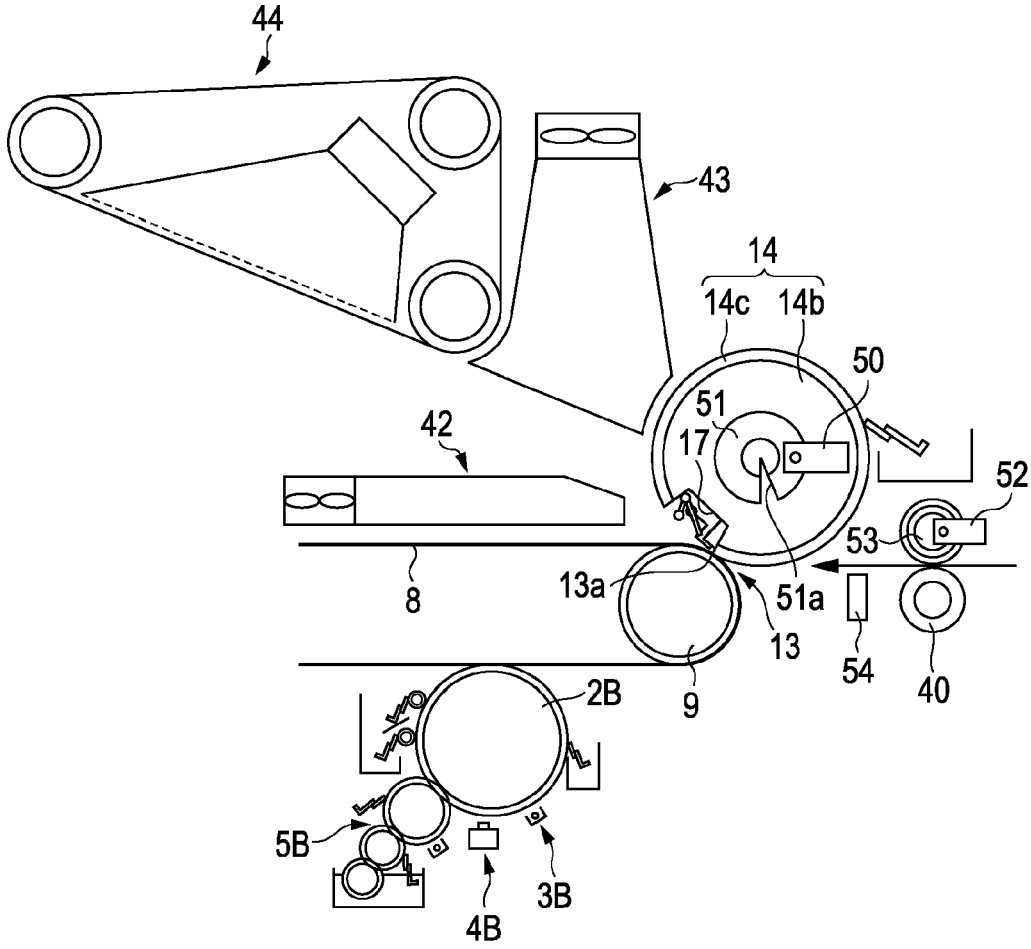
FIG. 8 is a drawing schematically showing a layout of detectors that respectively detect the secondary transfer roller rotational speed, the gate roller rotational speed, and the transfer medium moving speed.

As shown in FIG. 8, in one end side of the secondary transfer roller 14, an encoder 50 which is the secondary transfer roller rotational speed detector (speed detector) and a code wheel 51 adjacent to the encoder 50 are arranged. The code wheel 51 is constructed of a disk having a slit (notch) 51*a* and is arranged on the rotary shaft 14*a* of the secondary transfer roller 14 so as to rotate integrally with the secondary transfer roller 14. With respect to the encoder 50 and code wheel 51, a conventionally known encoder and code wheel can be used. Also, the angular velocity co (rpm) of the slit 51*a* of the code wheel 51 is detected by the encoder 50. Further, the peripheral speed (mm/s) of the outer peripheral surface of the secondary transfer roller 14 is calculated by a known calculation formula from the detected angular velocity co of the secondary transfer roller 14.

In addition, on one end side of the gate roller 40 also, an encoder 52 which is the gate roller rotational speed detector (speed detector) and a code wheel 53 adjacent to the encoder 52 are arranged. With respect to the encoder 52 and code wheel 53, a conventionally known encoder and a code wheel similar to the encoder 50 and the code wheel 51 are used respectively. Also, the peripheral speed of the gate roller 40 is calculated from the detected angular velocity of the gate roller 40 similarly to the case of the secondary transfer roller 14.

Figure 9:
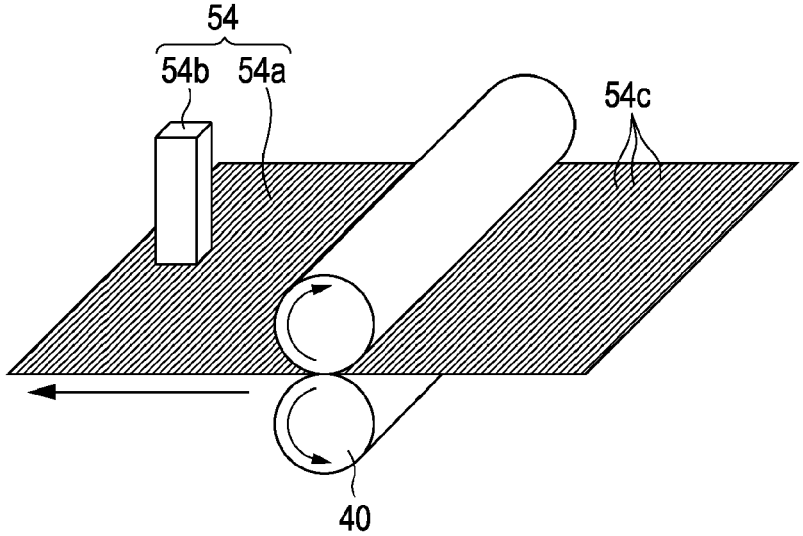
FIG. 9 is a drawing schematically showing the detector that detects the transfer medium moving speed.

Further, a transfer medium moving speed detector 54 that detects the moving speed (transporting speed) of a transfer medium 33*b* is disposed between the secondary transfer nip 13*a* and the gate roller 40. As shown in FIG. 9, the transfer medium moving speed detector 54 has a speed detecting transfer member 54*a* and an optical speed detecting sensor 54*b*. The speed detecting transfer medium 54*a* has many fine lines 54*c* printed thereon that extend in a direction orthogonal or approximately orthogonal to the transfer medium moving direction (transfer medium transporting direction). These fine lines 54*c* are formed at a constant pitch (for example, 100 μm) in the transfer medium moving direction.

For the optical speed detecting sensor 54*b*, for example, a reflection type sensor or the like is used. Also, the fine lines 54*c* are detected by the optical speed detecting sensor 54*b* when the speed detecting transfer member 54*a* passes the secondary transfer nip 13*a*. Further, based on the time interval between detections of the fine lines 54*c*, the moving speed of the speed detecting transfer member 54*a* while passing the secondary transfer nip, that is, the moving speed of transfer medium 33, is calculated. For example, when the time taken for one pitch of the fine lines 54*c* to pass as detected by the optical speed detecting sensor 54*b* is 0.0004 s (0.4 μs), the moving speed becomes $(100\times10^{-3})/0.0004=250.0$ mm/s.

Figure 10:
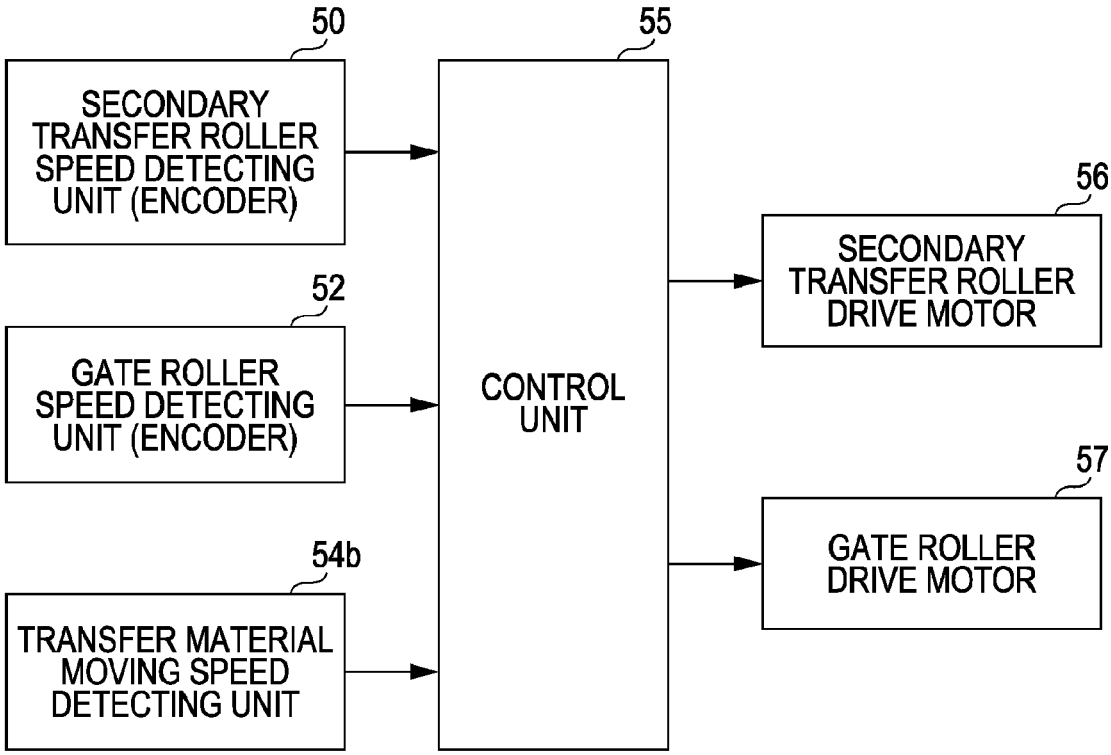
FIG. 10 is a block diagram of speed control.

The rotational speed of the secondary transfer roller 14 and the rotational speed of the gate roller 40 are controlled by an electronic control unit (control unit) of the image forming apparatus 1. In other words, as shown in FIG. 10, the detection signal of the angular velocity of the secondary transfer roller 14 from the encoder 50, the detection signal of the angular velocity of the gate roller 40 from the encoder 52, and the detection signal of the transfer medium moving speed from the optical speed detecting sensor 54*b* are inputted to the control unit 55 respectively. Based on these detection signals, the control unit 55 controls the rotation of a secondary transfer roller drive motor 56, and the intermediate transfer belt drive roller and gate roller drive motor 57 respectively. Thereby, the rotational speed of the secondary transfer roller 14 and the rotational speed of the gate roller 40 are controlled accurately.

The secondary transfer roller cleaning unit 15 removes the liquid developer adhered to the elastic member 14*c* of the secondary transfer roller 14 by using a cleaning member such as a cleaning blade. The liquid developer removed by the cleaning member is collected in a liquid developer container.

Also, as shown in FIG. 1, the image forming apparatus 1 is equipped with a first air flow generating device 42, a second air flow generating device 43, a transfer medium transporting unit 44, a third air flow generating device 45, and a fixing unit 46. The first air flow generating device 42 blows air toward the edge 33*a* of the transfer medium 33 released from gripping by the grippers 18 as shown by an arrow. Thereby, the edge 33*a* of the transfer medium 33 is prevented from moving together with the intermediate transfer belt 8. Further, the second air flow generating device 43 sucks air in the direction shown by an arrow. By sucking air by the second air flow generating device 43, the back face of the transfer medium 33 separated from the secondary transfer roller 14 is subjected to suction. Thereby, the transfer medium 33 moves toward the transfer medium transporting unit 44 by the rotational force of the intermediate transfer belt 8 and the secondary transfer roller 14 while being guided by the suction of the second air flow generating device 43.

The transfer medium transporting unit 44 includes a transfer medium transporting belt 44*a* having an endless shape rotating in the direction shown by an arrow and a sucking member 44*b* sucking air in the direction shown by an arrow. The transfer medium having moved to the transfer medium transporting unit 44 is transported toward the third air flow generating device 45 by the transfer medium transporting belt 44*a* while being subjected to suction by air sucking of the sucking member 44*b*. The third air flow generating device 45 sucks the air in the direction shown by an arrow. By sucking of air by the third air flow generating device 45, the back face of the transfer medium 33 separated from the secondary transfer roller 14 is subjected to suction. Thereby, the transfer medium 33 is moved toward the fixing unit 46 by the rotational force of the transfer medium transporting belt 44*a* while being guided by suction of the third air flow generating device 45. Then, the toner image on the transfer medium 33 is fixed under heat and pressure by the fixing unit 46.

Other structures and other image forming actions of the image forming apparatus 1 of this embodiment are similar to those of conventional image forming apparatuses using liquid developer, and therefore explanation thereof will be omitted.

In the image forming apparatus 1 provided with the secondary transfer unit 13 of this embodiment, the grippers 18 are configured to grip the edge 33*a* of the transfer medium 33 transported at a position where the recessed section 17 disposed with the grippers 18 and the gripper supporters 19 opposes the intermediate transfer belt 8. Thereby, the influence of variations in speed of the secondary transfer roller 14 due to pressing-contact of the intermediate transfer roller 8 and the secondary transfer roller 14 is not exerted. Accordingly, the transfer medium 33 can be securely and stably gripped by the grippers 18. As a result, the secondary transfer is performed for the transfer medium 33 securely and stably gripped, and therefore the transfer efficiency can be improved and more excellent image formation becomes possible.

Particularly, the first peripheral speed v1 (mm/s) of the secondary transfer roller 14 when the secondary transfer roller 14 abuts upon the intermediate transfer belt 8 is made to be faster than the second peripheral speed v2 (mm/s) of the secondary transfer roller 14 when the secondary transfer roller 14 does not abut upon the intermediate transfer belt 8. In other words, the second peripheral speed v2 (mm/s) is lower than the first peripheral speed v1 (mm/s). Thereby, the transfer medium 33 can be gripped by the grippers 18 more securely and more stably.

Also, the moving speed v3 (mm/s) of the intermediate transfer belt 8 and the moving speed v4 (mm/s) of the transfer medium 33 transported from the gate roller 40 are made to be equal or approximately equal to each other. Thereby, it becomes possible to transfer the toner image from the intermediate transfer belt 8 more accurately while the transfer medium 33 is gripped by the grippers 18 more securely and more stably.

Further, a motor which is the drive source that drives the intermediate transfer belt driving roller 9 (or, intermediate transfer belt 8) and a motor which is the drive source that drives the gate roller 40 are made to be the same motor 57. Thereby, rotation of the intermediate transfer belt 8 and the moving speed of the transfer medium 33 transported from the gate roller 40 can be more accurately controlled in a mutually related manner. In addition, the number of parts can be reduced and the image forming apparatus can be configured more simply.

Furthermore, the rotational speed of the secondary transfer roller 14 is detected by the encoder 50 and the code wheel 51. Also, based on the detected rotational speed, the control unit can execute controlling so that the second peripheral speed v2 (mm/s) of the secondary transfer roller 14 when the elastic member 14*c* of the secondary transfer roller 14 does not abut upon the intermediate transfer belt 8 becomes more accurately lower than the first peripheral speed v1 (mm/s) of the secondary transfer roller 14 when the elastic member 14*c* of the secondary transfer roller 14 abuts upon the intermediate transfer belt 8. Accordingly, the transfer medium 33 can be gripped more securely and more stably.

Also, an image on the liquid developer including the toner and the carrier liquid having been transferred to the intermediate transfer belt 8 is transferred to the transfer medium 33 while the edge 33*a* of the transfer medium 33 is gripped by the grippers 18. Accordingly, the transfer medium 33 can be separated from the intermediate transfer belt 8 more securely after the transfer. Thus, the transfer medium 33 can be gripped more securely and more stably while the transfer medium 33 is separated from the intermediate transfer belt 8 securely.

An example of the image forming apparatus 1 according to an aspect of the invention will be described.

First, respective speeds are set such that the first peripheral speed v1 of the secondary transfer roller 14 (the peripheral speed of the secondary transfer roller 14 when the elastic member 14*c* abuts upon the intermediate transfer roller 8) is set to 250 mm/s, the second peripheral speed v2 of the secondary transfer roller 14 (the peripheral speed of the secondary transfer roller 14 when the elastic member 14*c* does not abut upon the intermediate transfer belt 8) is set to 247.5 mm/s (less than the first peripheral speed v1 by 1%), and both the moving speed v4 of the transfer medium 33 (transfer medium transporting speed of the gate roller 40) and the peripheral speed of the intermediate transfer belt 8 are set to 250 mm/s (that is, v1=v4>v2).

Also, the pressing-contact force (nip load) F of the secondary transfer roller 14 is set to 90 kgf (900 N). Further, the width of the secondary transfer nip 13*a* (the length of the secondary transfer roller 14 in the rotational direction) is set to 5 mm, and the length of the secondary transfer nip 13*a* (the length of the secondary transfer roller 14 in the axial direction) is set to 300 mm. Accordingly, the nip pressure P at the secondary transfer nip 13*a* is P=900/0.5/30=60 (N/cm$^2$).

Figure 11:
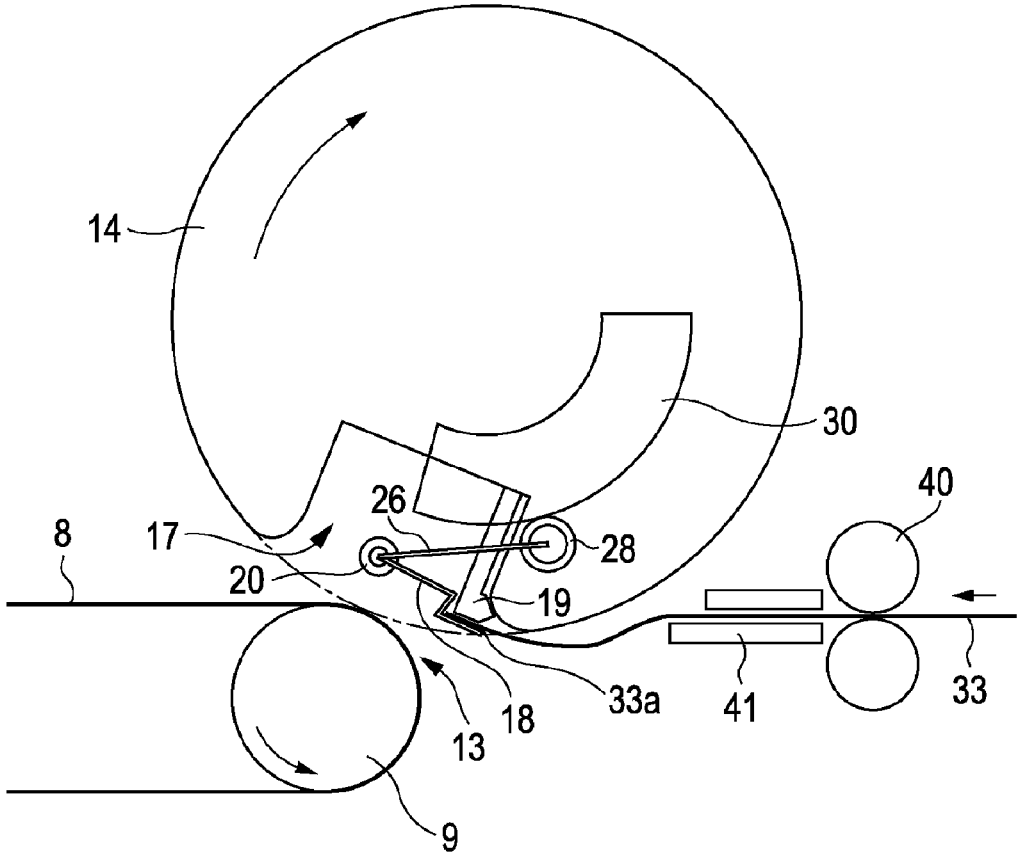
FIG. 11 is a drawing explaining gripping of the transfer medium in the image forming apparatus according to another embodiment of the invention.

Further, the transfer device and the image forming apparatus of the present invention is not limited to the example of the embodiment described above. For example, the first peripheral speed v1 (mm/s) and the second peripheral speed v2 (mm/s) of the secondary transfer roller 14 can be made equal to each other. That means, the rotational speed of the secondary transfer roller 14 is made constant regardless of whether the recessed section 17 opposes the intermediate transfer belt 8 or not. In this case, the transfer medium 33 does not become curved after being gripped by the grippers 18 as shown in FIG. 11, and is transported while abutting upon the outer peripheral surface of the secondary transfer roller 14.

Furthermore, although the intermediate transfer belt 8 is used as an image carrier in the example described above, an intermediate transfer drum can also be used, and a photoreceptor can be applied as well to the image carrier. Needless to say, when the photoreceptor is used for the image carrier, the toner image on the photoreceptor is transferred directly to the transfer medium. In addition, although the image forming apparatus of each example described above is a tandem type image forming apparatus, it may be an image forming apparatus of another type such as a monochrome image forming apparatus. In short, a variety of design variations are possible on the invention within the scope described in the claims.

The entire disclosure of Japanese Patent Application No: 2009-97956, filed Apr. 14, 2009 is expressly incorporated by reference herein.

What is claimed is:

1. A transfer device comprising:

an image carrier that carries an image; and a transfer roller having a recessed section, a transfer medium gripping member that is disposed in the recessed section and grips a transfer medium, and an elastic member that forms a transfer nip by abutting upon the image carrier, the transfer roller transferring the image carried by the image carrier to the transfer medium by abutting upon the image carrier, wherein the transfer medium gripping member grips the transfer medium when the recessed section moves to a position of the transfer nip and the image carrier and the transfer roller do not contact to each other, wherein a first peripheral speed v1 (mm/s) of the transfer roller when the transfer roller abuts upon the image carrier is faster than a second peripheral speed v2 (mm/s) of the transfer roller when the transfer roller does not abut upon the image carrier.

2. An image forming apparatus comprising:

an image carrier that carries an image;

a transfer roller having a recessed section, a transfer medium gripping member that is disposed in the recessed section and grips a transfer medium, and an elastic member forming a transfer nip by abutting upon the image carrier, the transfer roller transferring the image carried by the image carrier to the transfer medium by abutting upon the image carrier; and a gate roller that transports the transfer medium to the transfer medium gripping member, wherein the transfer medium gripping member grips the transfer medium when the recessed section moves to a position of the transfer nip and the image carrier and the transfer roller do not contact to each other, wherein a first peripheral speed v1 (mm/s) of the transfer roller when the transfer roller abuts upon the image carrier is faster than a second peripheral speed v2 (mm/s) of the transfer roller when the transfer roller does not abut upon the image carrier.

3. The image forming apparatus according to claim 2, wherein a moving speed v3 (mm/s) of the image carrier and a moving speed v4 (mm/s) of the transfer medium transported from the gate roller are equal or approximately equal to each other.

4. The image forming apparatus according to claim 2, wherein a drive source that drives the image carrier is the same as a drive source that drives the gate roller.

* * * * *